US005327694A

United States Patent [19]

Gamel et al.

[11] Patent Number: 5,327,694

[45] Date of Patent: Jul. 12, 1994

[54] ORNAMENTAL BUILDING COLUMN

[75] Inventors: Chris Gamel, West Vancouver; Dana Ramsay; Alan Burdett, both of North Vancouver, all of Canada

[73] Assignee: DCA Architectural Products Ltd., West Vancouver, Canada

[21] Appl. No.: 740,440

[22] Filed: Aug. 5, 1991

[51] Int. Cl.[5] ..... E04C 3/34; E04G 13/02

[52] U.S. Cl. ..... 52/727; 52/722; 52/725; 52/309.12; 249/48

[58] Field of Search ..... 52/722, 727, 725, 309.12; 249/48

[56] References Cited

U.S. PATENT DOCUMENTS

| | | | |
|---|---|---|---|
| 566,751 | 9/1896 | Gilman . | |
| 1,350,686 | 8/1920 | Trudelle | 52/727 |
| 2,505,426 | 4/1950 | O'Flaherty . | |
| 3,301,926 | 1/1967 | Reiland | 52/727 |
| 3,350,049 | 10/1967 | Reiland . | |
| 4,606,167 | 8/1986 | Thorne . | |
| 4,746,471 | 5/1988 | Hale | 52/2.15 |
| 4,887,789 | 12/1989 | Harris et al. . | |

FOREIGN PATENT DOCUMENTS

| | | |
|---|---|---|
| 1369144 | 8/1964 | France . |
| 15148 | of 1913 | United Kingdom . |
| 172171 | 12/1921 | United Kingdom . |

*Primary Examiner*—Carl D. Friedman
*Assistant Examiner*—Christopher T. Kent
*Attorney, Agent, or Firm*—Beehler & Pavitt

[57] ABSTRACT

A building structure comprising a tubular member made from cardboard having an applied covering layer of urethane foam that is formed into a desired shape. An internal load bearing member of reinforced concrete is installed within the interior of the tubular member to complete the structure. In addition, a method of making a decorative building structure is provided comprising the steps of: applying a covering layer to the exterior of a tubular member, sculpting the covering layer to a desired form, and installing a load bearing member within the interior of the tubular member.

9 Claims, 1 Drawing Sheet

ORNAMENTAL BUILDING COLUMN

FIELD OF THE INVENTION

This invention relates to a building structure and more particularly to a decorative structural column having any desired shape or surface design, and a method of forming such a structure.

BACKGROUND OF THE INVENTION

Columns formed from concrete or other suitable material are commonly used in buildings and other types of structures. These columns are generally formed using some sort of form or mold into which steel reinforcing bar and concrete are inserted. After the concrete has hardened, the form is stripped away to leave a standing column.

The concrete columns so formed generally have an irregular surface finish corresponding to the interior surface of the form. It is often a labour intensive and time consuming operation to prepare and smooth the column surfaces to an aesthetically more pleasing finish. In addition, columns constructed using molds or forms tend to be limited to a constant circular or rectangular cross-section to simplify the required mold or form. Columns can be sculpted into a desired form after casting but this is an expensive and time consuming procedure that requires highly skilled craftsmen.

U.S. Pat. No. 2,505,426 to O'Flaherty disclose a typical prior art concrete column molding system that uses a tarpaper form. This system is limited to essentially cylindrical columns.

U.S. Pat. No. 4,606,167 to Thorne discloses a method of enclosing structural supporting columns such as I-beams within a mould to produce a rounded column. The arrangement features the use of spaced ring members that act as guides in the formation of a rounded exterior surface.

U.S. Pat. No. 4,887,789 to Harris et al. discloses a mold for forming sculpted or ornate column. A mold must first be cut corresponding to the shape of the desired column and the mold must be separated from the cast column.

U.S. Pat. No. 566,751 to Gilman discloses a porous substrate adapted to accept a veneer of artificial stone in order to form structural ornamental columns.

SUMMARY OF THE INVENTION

There exists a need for a building structure that addresses the problems of the prior art by providing a column that can be easily formed into a desired ornamental shape in a relatively inexpensive and efficient process.

Accordingly, the present invention provides a building structure comprising:

a tubular member having an applied covering layer that is formed into a desired shape;

an internal load bearing means within the interior of said tubular member.

In a further aspect the present invention provides a method of making a decorative building structure comprising the steps of:

applying a covering layer to the exterior of a tubular member;

shaping the covering layer to a desired form; and installing a load bearing means within the interior of said tubular member.

In the method of the present invention, urethane foam is the preferred exterior covering layer and the tubular member is formed from cardboard. This arrangement provides a relatively lightweight, easily manipulated structure that can be shaped into a desired column shape on a lathe at the construction site or at a remote location. Subsequently, the formed column can be moved to the desired erection site and the reinforcing bars and concrete installed.

BRIEF DESCRIPTION OF THE DRAWINGS

The present invention is illustrated, merely by way of example in the accompanying drawings, in which.

DESCRIPTION OF THE PREFERRED EMBODIMENTS

Figure 1:
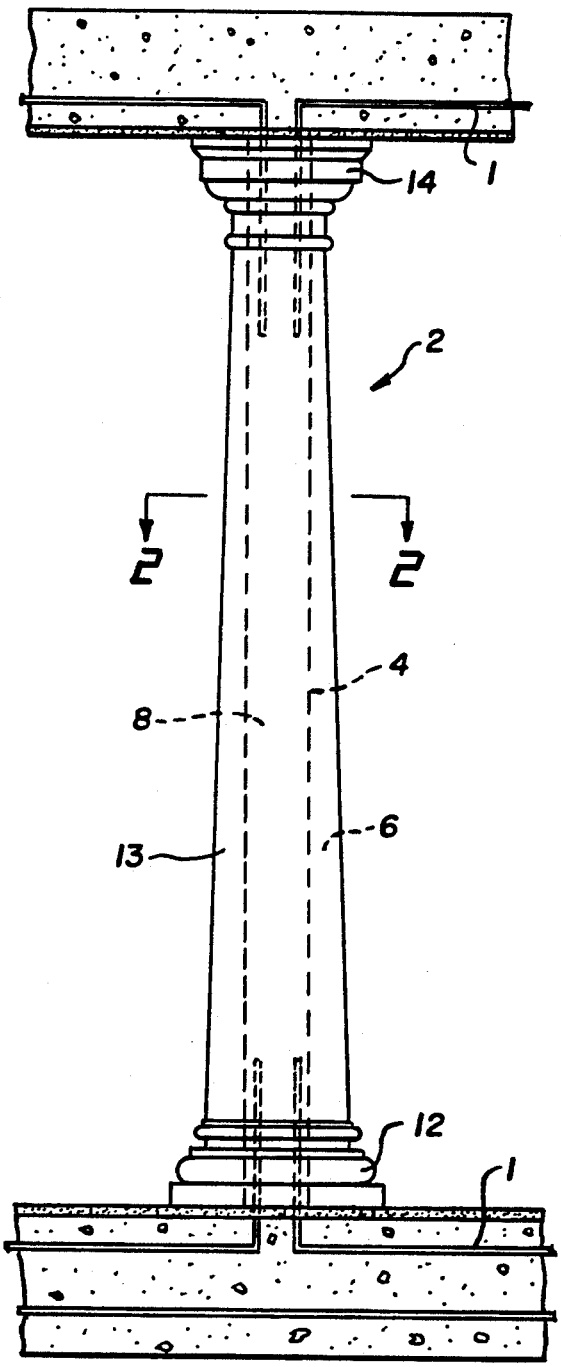
FIG. 1 is side elevation of a building structure according to the present invention.
Figure 2:
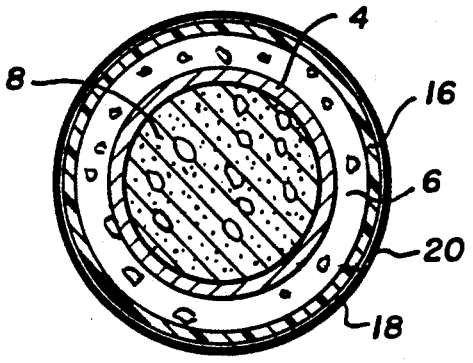
FIG. 2 is a section view taken along line 2—2 of FIG. 1 showing the cross-sectional arrangement of the building structure.

FIG. 1 shows a building structure in the form of an ornate column 2 constructed according to the present invention. The internal structure of column 2 is shown in FIG. 2 which represents a typical cross section through the column along the line 2—2.

The structure comprises a tubular member 4 having an applied covering layer 6 that is formed into a desired shape. In the preferred embodiment, tubular member 4 is a cardboard tube of the type that is presently used as a disposable mold for concrete columns. The cardboard tube is generally referred to in the industry as a "sonotube". The applied covering layer is any easily applied and sculpted material. Preferably, applied covering layer 6 comprises urethane foam that is sprayed onto the cardboard tubular member. In forming a building structure according to the present invention, tubular member 4 can be set up in a lathe and rotated. Urethane foam is applied to the rotating tubular member to establish a rough shape that is oversize but approximates the final desired form of the building structure to be created.

Tube 4 and applied covering layer 6 provide a relatively light weight structure that is easily manipulated. While still on the lathe the covering layer can be shaped to the desired final shape and the covering surface smoothed by sanding to create an appropriate finish using conventional tools.

The combined tube and applied covering layer is then placed in position at the desired location at the construction site. Internal load bearing means in the form of reinforced concrete 8 is installed within the interior of tube 4 to create a structural member 2 with an ornate exterior of any desired shaped. Note in FIG. 1 that the load bearing means preferably incorporates reinforcing bars 1 that extend into the floor and ceiling.

While the building structure of the present invention can be formed in part at an assembly plant and the rest of the structure at the work site, as described above, it is also possible to assemble the structure entirely at a construction plant. For example, it is possible to install the load bearing means when the structure is being created and transport the completed structure to the work site.

As an example, the column of FIG. 1 has had its applied covering layer 6 sculpted into a column having an ornate base 12, a tapering shaft 13 and an ornate top 14. The sculpted applied covering layer has no real load bearing capabilities and any load is supported by internal concrete shaft 8 within cardboard tubular member 4 shown by dashed lines.

It is intended that additional layers can be applied to the foam covering layer to strengthen, waterproof or alter the appearance of the structure.

A fabric or resin layer 16 can be applied to the outer surface of the sculpted covering layer 6 to strengthen the urethane foam and provide desired rigidity.

A resin layer will tend to impregnate and saturate the porous foam surface. Preferably, the resin is pigmented to suit the base colour of the desired finishing layer.

If a resin layer is used, sand, aggregate, copper or tile can be applied to the resin layer to create a textured finish.

A paint finish 18 can also be applied to the exterior of the structure to give the appearance of a textured finish. A "faux" paint finish can be used to create the appearance of marble, granite or other faux finishes.

A final transparent clear coat 20 can be applied as a protective coat and also a weatherproof finish.

The building structure of the present invention is also intended for retrofitting to existing structural columns. A tubular member of appropriate dimensions to surround the existing column is selected and a covering layer is applied and shaped as previously described. The tubular form is then cut in half longitudinally before the final finishing layers are applied. The tubular form halves are fitted over the existing structural columns and glued together along their seams. Final finishing can then be applied.

The present invention provides a relatively inexpensive and easily formed building structure that is easily handled and is aesthetically pleasing to the eye. While polyurethane foam has been specifically mentioned as a preferred covering layer, it will be appreciated that other types of plastic foam material can also be used.

Although the present invention has been described in some detail by way of example for purposes of clarity and understanding, it will be apparent that certain changes and modifications may be practised within the scope of the appended claims.

We claim:

1. An ornamental building structure comprising:

a tubular member having a hollow interior and an exterior surface;

a substantially non-load bearing layer of substantially rigid light-weight synthetic foam applied to said exterior surface and shaped to define an arbitrary ornamental exterior profile of varying radial dimension along at least part of said tubular member;

a thin outer decorative layer applied over said synthetic foam preserving said profile; and concrete load bearing means extending through said tubular member within said hollow interior.

2. A building structure as claimed in claim 1 in which said tubular member comprises a cardboard tube.

3. A building structure as claimed in claim 1 in which said load bearing means comprises reinforced concrete.

4. A building structure as claimed in claim 1 in which the finishing layer comprises a fabric layer.

5. A building structure as claimed in claim 1 in which the finishing layer comprises a resin layer.

6. A building structure as claimed in claim 6 in which said resin layer is pigmented to match the colour of the desired exterior finish.

7. A building structure as claimed in claim 1 in which a faux paint finish is applied to the finishing layer.

8. A building structure as claimed in claim 1 in which a surface finish material is applied over the finishing layer.

9. A building structure as claimed in claim 8 in which the surface finish material is selected from the group consisting of sand, aggregate, copper and tiles.

* * * * *